US008172525B2

(12) United States Patent
Fukami

(10) Patent No.: US 8,172,525 B2
(45) Date of Patent: May 8, 2012

(54) CENTRIFUGAL COMPRESSOR

(75) Inventor: Koji Fukami, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 771 days.

(21) Appl. No.: 12/261,949

(22) Filed: Oct. 30, 2008

(65) Prior Publication Data

US 2009/0214334 A1 Aug. 27, 2009

(30) Foreign Application Priority Data

Feb. 27, 2008 (JP) ..... 2008-046930

(51) Int. Cl.
*F04D 29/44* (2006.01)

(52) U.S. Cl. ..... 415/212.1; 415/119; 415/206

(58) Field of Classification Search ..... 415/119, 415/206, 211.2, 212.1, 185
See application file for complete search history.

(56) References Cited

U.S. PATENT DOCUMENTS 4,743,161 A 5/1988 Fisher et al.
2004/0047722 A1* 3/2004 Chen et al. ..... 415/1

FOREIGN PATENT DOCUMENTS

JP 60-166799 A 8/1985
JP 2002-364586 A 12/2002
JP 2004-27931 A 1/2004
JP 2004027931 A * 1/2004

OTHER PUBLICATIONS

Tramslation of Ibaraki, et al (JP 2004-027931 A) (Jan. 29, 2004), 6 pages.*

* cited by examiner

*Primary Examiner* — Caridad Everhart
(74) *Attorney, Agent, or Firm* — Birch, Stewart, Kolasch & Birch, LLP

(57) ABSTRACT

A centrifugal compressor in which frequency of noise produced by rotation of the impeller does not resonate with natural frequency of vibration of gas in a plurality of axial slots serving to increase gas flow rate in an operation range of increased gas flow rate and broaden stable operation range in an operation range of decreased gas flow rate is provided. The axial slots are formed between the peripheral part of the inlet passage of the compressor housing by the peripheral surface of the inlet passage and an annular ring part of the housing supported by a plurality of struts extending from the peripheral surface, four or more struts are provided to support the annular ring part, and all but one are located at positions determined when all the struts are located at circumferentially equal spacing and the one strut is shifted from the positions by a certain angle.

6 Claims, 6 Drawing Sheets

CENTRIFUGAL COMPRESSOR

BACKGROUND OF THE INVENTION

1. Field of the Invention

The present invention relates to a centrifugal compressor for an exhaust turbo charger, etc., a compressor housing of which has an inlet passage having a diameter larger than the diameter of an annular inlet area of the impeller of the compressor, and a plurality of slots are formed in the housing near the annular inlet area of the impeller so that gas introduced from the inlet passage can be introduced into the impeller through the slots at the outer periphery of the leading edge parts of the blades in addition to gas introduced into the impeller from the annular inlet area of the impeller or gas introduced from the annular inlet area can be bleed from the impeller through the slots to the inlet passage to be again sucked into the impeller from the annular inlet area, particularly a centrifugal compressor in which said plurality of slots are arranged circumferentially concentrically with the center of rotation of the impeller.

2. Description of the Related Art

A centrifugal compressor of an exhaust turbocharger has a stationary housing and an impeller supported for rotation in the housing, the impeller being rotated by a turbine rotor driven by exhaust gas of an engine. Air sucked in from the inlet passage of the housing is introduced into the impeller through the annular inlet area of the impeller, compressed therein by centrifugal force exerting on the gas sucked in the impeller, and discharged from the peripheral outlet area of the impeller to the outlet passage of the housing to be supplied to the engine therefrom.

It is demanded in the field of the centrifugal compressor of the exhaust turbocharger to broaden stable operation range of the compressor. In Document 1 (Japanese Laid-Open Patent Application No. 2004-27931) is disclosed a centrifugal compressor in which a plurality of slots are formed in the compressor housing near the annular inlet area of the impeller so that gas introduced from the inlet passage can be introduced into the impeller through the slots at the outer periphery of the leading edge parts of the blades in addition to gas introduced into the impeller from the annular inlet area of the impeller in an operation range of increased gas flow rate or gas introduced from the annular inlet area can be bleed from the impeller through the slots to the inlet passage to be again sucked into the impeller from the annular inlet area in an operation range of decreased gas flow rate, said plurality of slots being arranged circumferentially concentrically with the center of rotation of the impeller and formed to open to the spaces between the blades of the impeller at meridional distance from the leading edge of the blade in the range of 2~21% of the meridional length along the contoured outer tip of the blade from the annular inlet area to the peripheral outlet area of the impeller, that is, from the leading edge to the trailing edge of the blade along the outer tip thereof, and said plurality of slots being formed between the inner surface of the inlet passage of the housing near the annular inlet area of the impeller and the outer periphery of an annular ring part, the inner periphery of which composes the outer periphery of the annular inlet area of the impeller, with the annular ring part supported by a plurality of struts extending from the inner surface of the inlet passage of the housing radially inwardly, thus the slots being partitioned by the struts.

However, there is a possibility that the noise produced by rotation of the impeller having a plurality of blades for compressing the gas sucked in the impeller, frequency of the noise being determined by the number of blades and rotation speed of the impeller, resonates with the vibration of gas in the slots, of which the natural frequency is determined by the length of the slot, and excessive noise is produced. Strength of the noise is influenced by the number of the struts partitioning the slots and circumferential location of the struts.

SUMMARY OF THE INVENTION

The present invention was made in light of the problems of the prior art, and the object of the invention is to provide a centrifugal compressor with which frequency of noise produced by rotation of the impeller having a plurality of blades does not resonate with natural frequency of vibration of gas in a plurality of axial slots which serve to increase gas flow rate in an operation range of increased gas flow rate and broaden stable operation range in an operation range of decreased gas flow rate resulting in reduction of noise caused by rotation of the impeller.

To attain the object, the present invention proposes a centrifugal compressor comprising: a stationary housing and an impeller supported rotationally in the housing, the housing having an inlet passage of diameter larger than that of an annular inlet area of the impeller including a plurality of radially outwardly directed blades thereon, each blade including a leading edge, a trailing edge, and an outer tip, a plurality of slots being formed in a peripheral part of the inlet passage of the housing near the annular inlet area of the impeller between an annular ring supported by a plurality of struts extending axially inwardly from a surface of the peripheral part such that the plurality of slots are partitioned by the struts and arranged circumferentially concentrically with the center of rotation axis of the impeller, an end of each of the slots being opened to the inlet passage at the peripheral part thereof and the other end being open to gas flow space of the impeller at the outer tip near the leading edge via an annular slit behind the annular ring part, wherein four or more struts are provided to support the annular ring part such that all the struts except one strut are located at positions which are determined when all the struts are to be located at circumferentially equal spacing and said one strut is located at a position shifted circumferentially from one of said equally spaced positions by a certain central angle.

It is suitable that positions are determined to locate the plurality of struts plus one strut circumferentially at equal spacing, and the plurality of struts are located at said determined positions excluding said one strut so that no strut is provided at one of said equally spaced positions.

This situation corresponds to a situation that said certain central angle is 360°/(T+1), where T is the total number of struts. It means that no strut is provided at one of positions determined for (T+1) struts when (T+1) struts are to be located at circumferentially equally spacing.

It is suitable to locate a plurality of struts as follows:

(1) The annular ring part is supported by 4 struts, and one of them is located at a position shifted circumferentially by a central angle of =((180/T)×(½~⅓))° from one of positions which are determined when all 4 struts are to be provided at circumferentially equal spacing, where T is total number of struts.

Particularly, it is preferable that the annular ring part is supported by 4 struts, and one of them is located at a position shifted circumferentially by a central angle of 18° from one of positions which are determined when all 4 struts are to be provided at circumferentially equal spacing, where T is total number of struts.

(2) The annular ring part is supported by 5 or 6 struts, and one of them is located at a position shifted circumferentially by a central angle of $((180/T)\times(1/2))^\circ$ from one of positions which are determined when all struts are to be provided at circumferentially equal spacing, where T is total number of struts.

(3) The annular ring part is supported by 7 or more struts, and one of them is located at a position shifted circumferentially by a central angle of $(180/T)^\circ$ from one of positions which are determined when all struts are to be provided at circumferentially equal spacing, where T is total number of struts.

According to the invention, the annular ring part is supported by 4 or more struts, and one strut is shifted circumferentially by a central angle from one of positions which will be determined when all struts are provided at circumferentially equal spacing, or one of the struts is not provided at one of positions which will be determined when the plurality of struts plus one strut are provided at circumferentially equal spacing, so unequally spaced portion of the struts is produced, vibration exciting force components of frequency of integral multiple of the number of the struts decreases as compared with the case all the struts are located at equal circumferential spacing, and increase of vibration exciting force components of frequency other than integral multiple of the number of the struts can be suppressed to the minimum.

DETAILED DESCRIPTION OF THE PRESENT INVENTION

Embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 1:
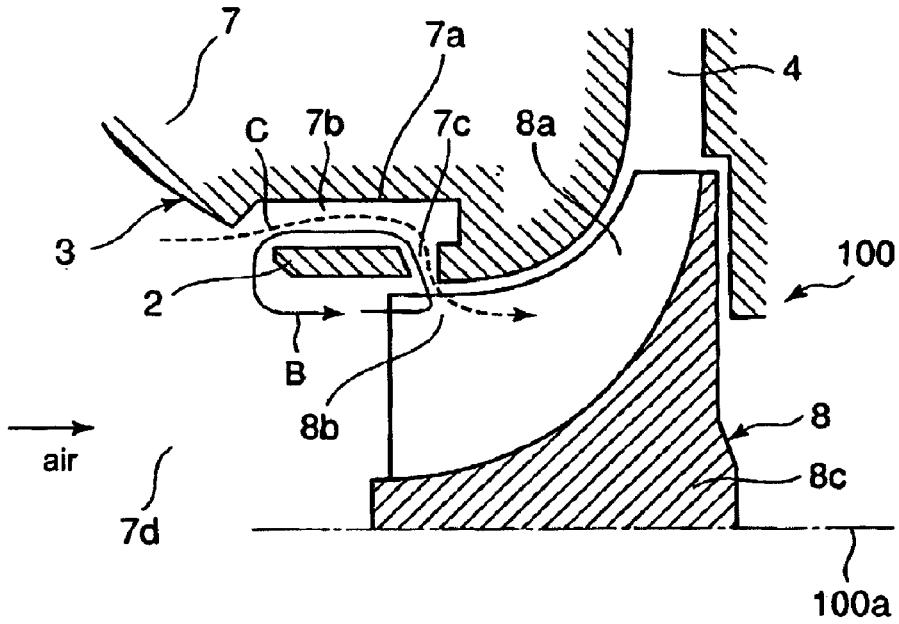
FIG. 1 is a sectional view of a substantial part of a centrifugal compressor according to the invention.
Figure 2:
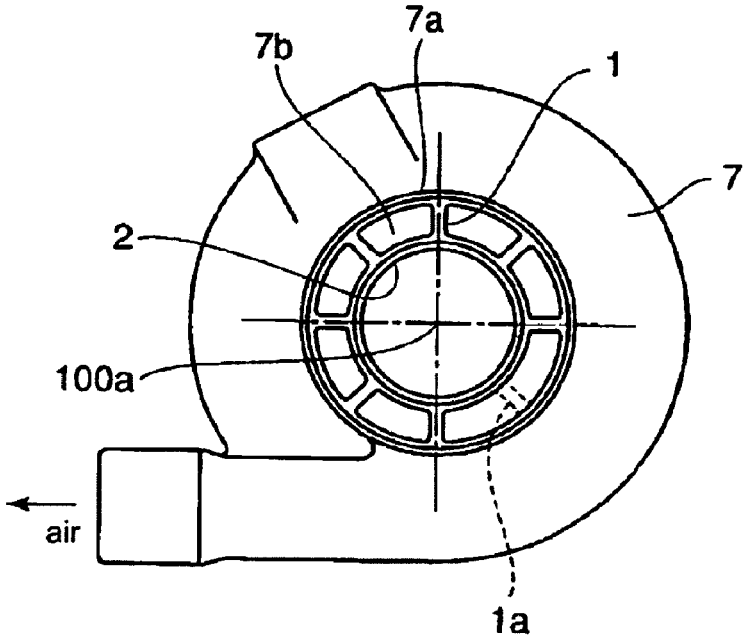
FIG. 2 is an external view of a centrifugal compressor viewed from an air inlet side.
Figure 3:
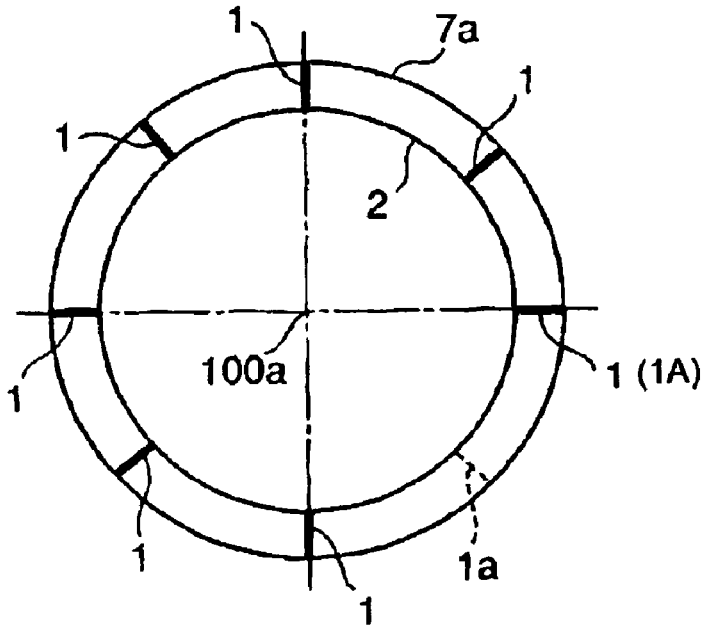
FIG. 3 is a drawing showing location of struts for partitioning slots according to the first embodiment of the invention.

FIG. 1 is a sectional view of a substantial part of a centrifugal compressor according to the invention, and FIG. 2 is an external view of the centrifugal compressor viewed from an air inlet side. FIG. 3 is a drawing showing location of struts for partitioning slots according to the first embodiment of the invention.

Referring to FIG. 1, a centrifugal compressor 100 includes a compressor housing 7, an impeller 8 supported for rotation in the housing and a diffuser 4. The impeller 8 has a plurality of radially outwardly directed blades 8*a* on a hub 8*c* thereof, each including a leading edge, a trailing edge, and a contoured outer tip, the outer tip being free and located in close spaced relationship with a part of the inner surface of the compressor housing 7 shrouding the contoured outer tip of each blade. Reference numeral 100*a* indicates center of rotation of the impeller 8 and an inlet passage 7*d* of the housing 7.

Reference numeral 8*b* indicates a leading end region of the contoured outer trip of the blade 8*a*.

Referring to FIG. 1 and FIG. 2, an annular ring part 2 is supported by a plurality of struts 1 extending from an inner surface 7*a* of the housing 7 near annular inlet area of the impeller 8 so that a plurality of slots 7*b* are formed between the inner surface 7*a* and the outer periphery of the annular ring part 2. One end of each slot 7*b* is opened to the peripheral region of the inlet passage 7*d* via an opening C and the other end thereof is opened to the space between the blades of the impeller 8 at the leading end region of the contoured outer tip of the blade 8*a* via an annular slit 7*c*. Thus, the plurality of slots 7*b* are arranged circumferentially concentrically with the center of rotation of the impeller 8 partitioned by the plurality of struts 1 with each slot 7*b* communicating to the air flow space of the impeller 8 at the leading end region 8*b* of the contoured outer tip via the annular slit 7*c*.

When the compressor 100 is operated at a large air flow rate range, pressure in the leading end region 8*b* is lower than that in the inlet passage 7*d*, so air flowing in the inlet passage 7*d* in the peripheral region thereof is sucked through the slots 7*b* and annular slit 7*c* into the air flow space in the impeller, i.e. spaces between the blades in the impeller as shown by a broken line in addition to air sucked into the air flow space through the annular inlet area of the impeller 8. Therefore, pressurized air supplied by the compressor is increased as compared with conventional compressor not provided with the slots 7*b* and annular slit 7*c*.

When the compressor 100 is operated at a low air flow rate range near the surging line, pressure in the leading end region 8*b* is higher than that in the inlet passage 7*d*, so air in the air flow space in the impeller flows out through the annular slit 7*c* and slots 7*b* toward the inlet passage 7*d* and this air is again sucked into the air flow space through the annular inlet area of the impeller 8 as shown by an arrow B. Therefore, pressurized air discharged from the compressor decreases and the surge line is shifted toward lower air flow rate, resulting in widened stable operation range.

In FIG. 2 showing an external view of the centrifugal compressor viewed from the air inlet side, one of eight struts positioned at equal circumferential spacing is removed, which one being indicated by 1*a*. This location of struts is shown in FIG. 3 as a first embodiment. In FIG. 3, circumferentially equally spaced eight positions are indicated by reference numerals 1A's and 1*a*, seven struts are provided at seven positions indicated by 1A's, and no strut is provided at the position 1*a*.

Result of measurement of noise in the case of the first embodiment showed that vibration exciting force components of frequency of integral multiple of the number of the struts decreased by about 10% as compared with the case the eight struts were positioned at equal circumferential spacing. By this, increase of vibration exciting force components of frequency other than integral multiple of the number of the struts can be suppressed to the minimum.

Hereunder, second to fifth embodiments are described in which one of a plurality of struts equal to or greater than 4 is shifted circumferentially from a circumferentially equally spaced position.

The Second Embodiment

Figure 4:
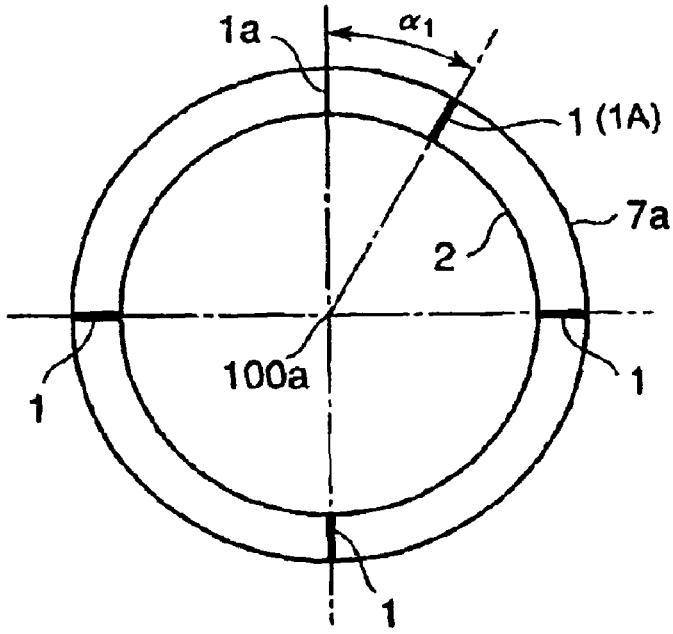
FIG. 4 is a drawing showing location of struts for partitioning slots according to the second embodiment of the invention.

FIG. 4 is a drawing showing location of the struts for partitioning the slots according to the second embodiment.

In the second embodiment, the annular ring part 2 is supported by 4 struts, and one strut is shifted circumferentially in clockwise direction by a central angle $\alpha_1$ (=((180/T)×(½−⅓))°) from a position 1*a* which is one of positions determined when all struts are to be provided at circumferentially equal spacing, where T is total number of struts.

Result of measurement of noise showed that, by shifting one of 4 struts circumferentially by the central angle $\alpha_1$ to produce unequally spaced portion of the struts, vibration exciting force components of frequency of integral multiple of the number of the struts decreased by about 50% or less as compared with the case the 4 struts were positioned at equal circumferential spacing.

The Third Embodiment

Figure 5:
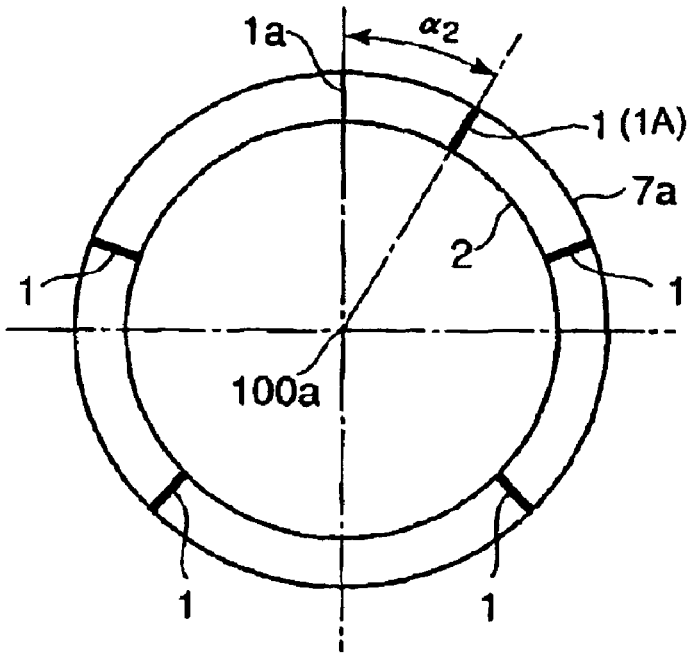
FIG. 5 is a drawing showing location of struts for partitioning slots according to the third embodiment of the invention.

FIG. 5 is a drawing showing location of the struts for partitioning the slots according to the third embodiment.

In the third embodiment, the annular ring part 2 is supported by 5 or 6 struts (in the example of FIG. 5, the number of struts is 5), and one strut is shifted circumferentially in clockwise direction by a central angle $\alpha_2$ (=((180/T)×(½))) from a position 1*a* which is one of positions determined when all 4 struts are to be provided at circumferentially equal spacing, where T is total number of struts.

Figure 8:
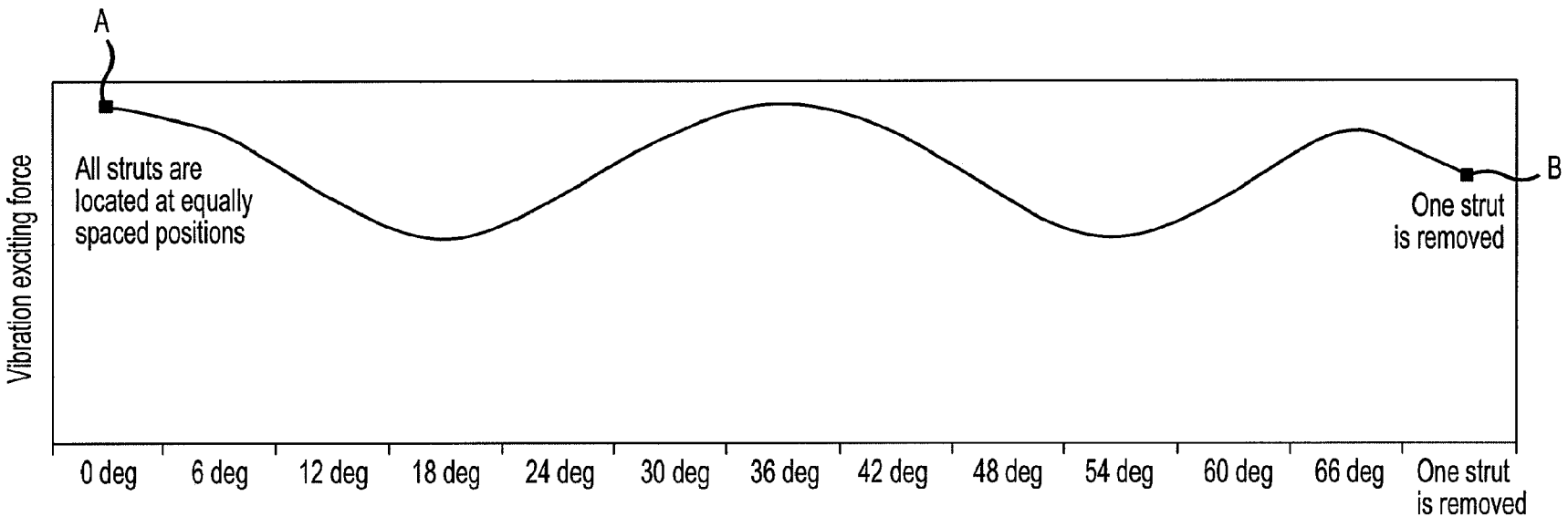
FIG. 8 is a graph showing vibration exciting force obtained from an experiment in the case of the third embodiment.

Result of measurement of noise in the case of the third embodiment when the number of struts is 5 is shown in the graph of FIG. 8. By shifting one of 5 struts to produce unequally spaced portion of the struts, vibration exciting force components of frequency of integral multiple of the number of the struts decreased by about 40% or less as compared with the case the 5 struts was positioned at equal circumferential spacing. In the graph, the coordinate represents vibration exciting force and abscissa represents shift angle $\alpha_2$ of one of the struts as shown in FIG. 5. In FIG. 8, "A" indicates vibration exciting force when $\alpha_2$=0, i.e. when all 5 struts are located at equally spaced positions, the vibration exciting force at "A" being taken as reference value. When the number of struts is 5 and they are equally spaced, the central angle between adjacent struts is 72 degrees. Change of vibration exciting force when shift angle $\alpha_2$ of one of the struts is changed is shown in FIG. 8. It is recognized from FIG. 8 that vibration exciting force is minimum when $\alpha_2$ is 18 degrees and 54 degrees. Thus, it is understood that vibration exciting force can be reduced by about 40% by shifting one of the struts by a central angle of 18 degrees or 54 degrees as compared with a case all the struts are located at equal circumferential spacing when 5 struts are provided to support the annular ring part 2. In FIG. 8, "B" indicates when $\alpha_2$ is 72 degrees, that is, one of the 5 struts is removed.

The Fourth Embodiment

Figure 6:
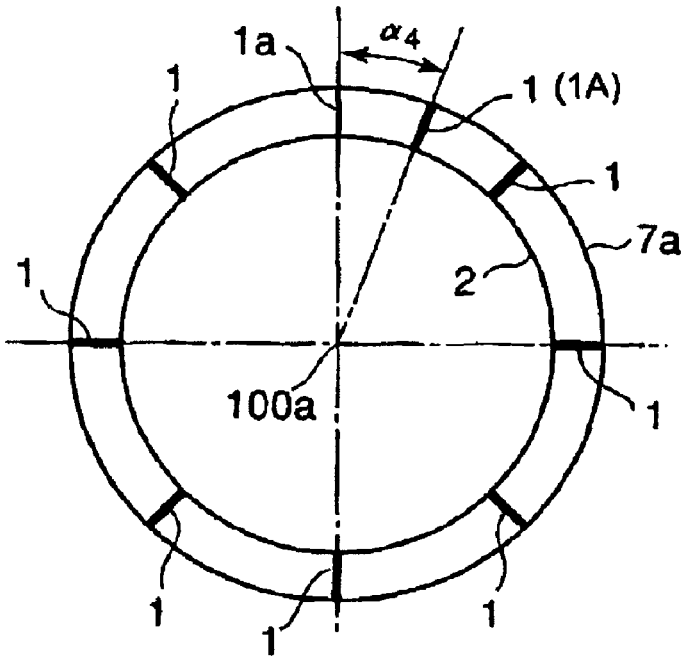
FIG. 6 is a drawing showing location of struts for partitioning the slots according to the fourth embodiment of the invention.

FIG. 6 is a drawing showing location of the struts for partitioning the slots according to the fourth embodiment.

In the fourth embodiment, the annular ring part 2 is supported by 7 or more struts (in the example of FIG. 6, the number of struts is 7), and one strut is shifted circumferentially in clockwise direction by a central angle $\alpha_4$ (=(180/T)°) from a position 1*a* which is one of positions determined when all struts are to be provided at circumferentially equal spacing, where T is total number of struts.

Result of measurement of noise in the case of the fourth embodiment showed that vibration exciting force components of frequency of integral multiple of the number of the struts decreased by about 30% or less by shifting one strut circumferentially by the central angle $\alpha_4$ from the position 1*a* as compared with the case the 7 or more struts were positioned at equal circumferential spacing.

The Fifth Embodiment

Figure 7:
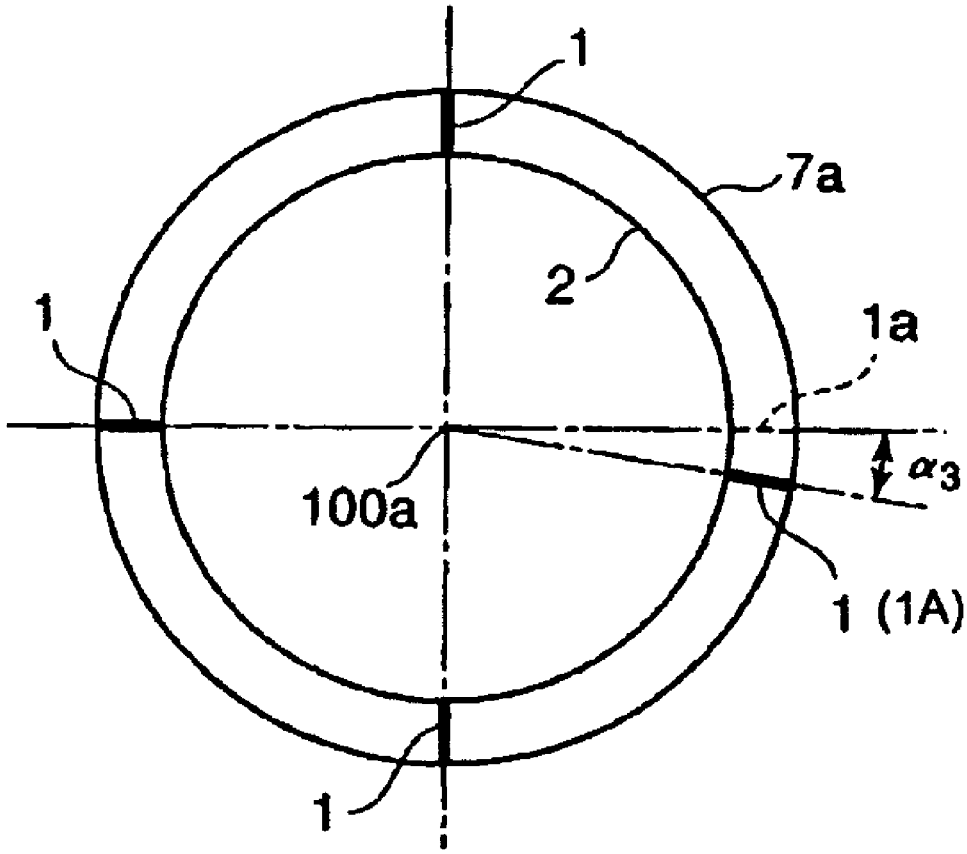
FIG. 7 is a drawing showing location of struts for partitioning slots according to the fifth embodiment of the invention.

FIG. 7 is a drawing showing location of the struts for partitioning the slots according to the fifth embodiment.

In the fifth embodiment, the annular ring part 2 is supported by 4 struts, and one strut is located at a position shifted circumferentially by a central angle $\alpha_3$ of 18° from a position 1*a* which is one of positions determined when all 4 struts are to be provided at circumferentially equal spacing.

Result of measurement of noise showed that, by shifting one of 4 struts circumferentially by a central angle of 18° to produce unequally spaced portion of the struts, vibration exciting force components of frequency of integral multiple of the number of the struts decreased by about 50% or less as compared with the case the 4 struts were positioned at equal circumferential spacing.

Figure 9:
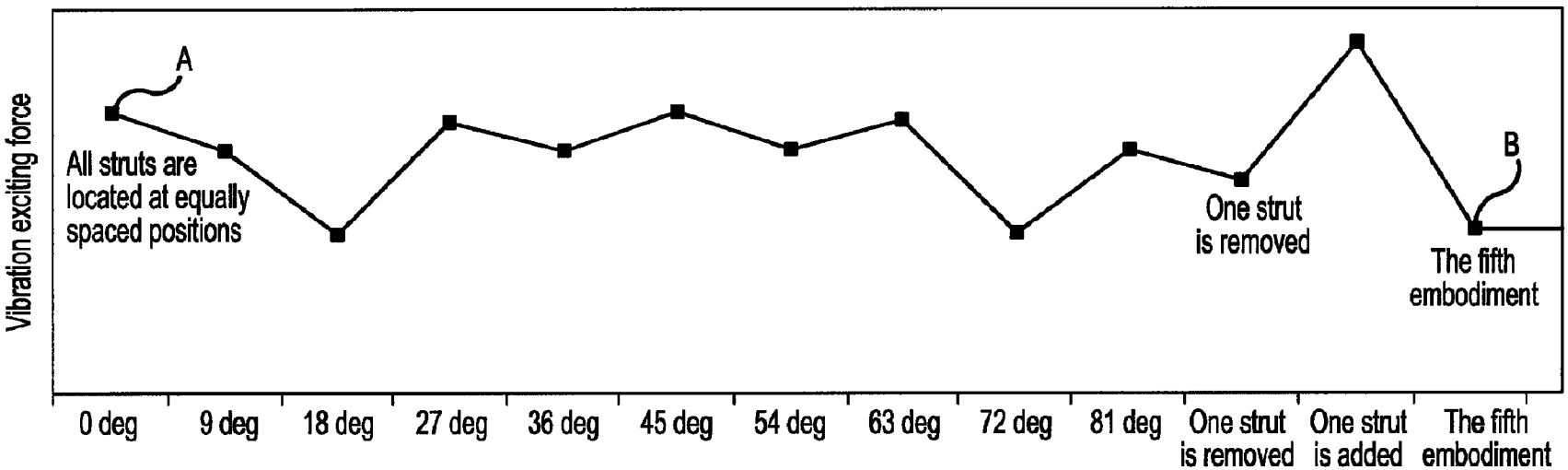
FIG. 9 is a graph showing vibration exciting force obtained from an experiment in the case of the fifth embodiment.

A result of the measurement is shown in the graph of FIG. 9. The graph shows when 4 struts are provided. When 4 struts are located at circumferentially equal spacing, the central angle between adjacent struts is 90 degrees. In FIG. 9, "A" indicates vibration exciting force when $\alpha_3$=0, i.e. when all 4 struts are located at equally spaced positions, the vibration exciting force at "A" being taken as reference value. In the case 5 struts are provided of which the result is shown in FIG. 5, vibration exciting force changes in a sinusoidal curve as angle $\alpha_2$ increases, whereas vibration exciting force does not change in that way as angle $\alpha_3$ increases in the case in which 4 struts are provided. In this case, vibration exciting force is decreased when angle $\alpha_3$ is 18 degrees and 72 degrees, and the vibration exciting force is symmetrical in relation to an ordinate passing a 3 of 45 degrees.

Vibration exciting force at a point "one strut is removed" at 90 degrees on the abscissa corresponds to that when $\alpha_3$ is 90 degrees and the number of struts are 3.

Vibration exciting force at a point "one strut is added" indicates that when one strut is added so that total number of struts is 5.

Vibration exciting force at point "B" indicates that in the case of $5^{th}$ embodiment shown in FIG. 7 in which 4 struts are provided and strut shift angle $\alpha_3$ is near 18 degrees or 72 degrees.

According to the invention, location of a plurality of struts for forming a plurality of slots to communicate the peripheral region of the inlet passage of the compressor housing to the gas flow space of the impeller of the compressor by supporting the annular ring part located near the annular inlet area of the impeller, can be determined so that frequency of noise produced by the rotation of the impeller to pressurize gas does not resonate with natural frequency of vibration of gas in the axially extending slots depending on the number of the struts, and a centrifugal compressor of this type decreased in noise by preventing resonance of noise produced by the rotation of the impeller with vibration of gas in the slots can be provided.

The invention claimed is:

1. A centrifugal compressor, comprising:

a stationary housing; and an impeller of the compressor, the impeller being supported rotationally in the housing, the housing having an inlet passage of diameter larger than that of an annular inlet area of the impeller including a plurality of radially outwardly directed blades thereon, each blade including a leading edge, a trailing edge, and an outer tip, a plurality of slots being formed in a peripheral part of the inlet passage of the housing near the annular inlet area of the impeller between an annular ring supported by a plurality of struts extending axially inwardly from a surface of the peripheral part such that the plurality of slots are partitioned by the struts and arranged circumferentially concentrically with the center of rotation axis of the impeller, an end of each of the slots being opened to the inlet passage at the peripheral part thereof and the other end being open to gas flow space of the impeller at the outer tip near the leading edge via an annular slit behind the annular ring part, wherein four or more struts are provided to support the annular ring part such that all the struts except for only one strut are located at positions which are determined when all the struts are to be located at circumferentially equal spacing and said only one strut is located at a position shifted circumferentially from one of said equally spaced positions by a certain central angle.

2. A centrifugal compressor according to claim 1, wherein positions are determined to locate the plurality of struts plus only one strut circumferentially at equal spacing, and the plurality of struts are located at said determined positions excluding said one strut so that no strut is provided at one of said equally spaced positions.

3. A centrifugal compressor according to claim 1, wherein the annular ring part is supported by 4 struts, and only one of said 4 struts is located at a position shifted circumferentially by a central angle of $=((180/T)\times(1/2\sim1/3))^\circ$ from one of positions which are determined when all 4 struts are to be provided at circumferentially equal spacing, where T is total number of struts.

4. A centrifugal compressor according to claim 1, wherein the annular ring part is supported by 4 struts, and only one of said 4 struts is located at a position shifted circumferentially by a central angle of 18° from one of positions which are determined when all 4 struts are to be provided at circumferentially equal spacing, where T is total number of struts.

5. A centrifugal compressor according to claim 1, wherein the annular ring part is supported by 5 or 6 struts, and only one of said 5 or 6 struts is located at a position shifted circumferentially by a central angle of $((180/T)\times(1/2))^\circ$ from one of positions which are determined when all struts are to be provided at circumferentially equal spacing, where T is total number of struts.

6. A centrifugal compressor according to claim 1, wherein the annular ring part is supported by 7 or more struts, and only one of said 7 or more struts is located at a position shifted circumferentially by a central angle of $(180/T)^\circ$ from one of positions which are determined when all struts are to be provided at circumferentially equal spacing, where T is total number of struts.

* * * * *